United States Patent [19]

Clark

[11] Patent Number: 4,548,408

[45] Date of Patent: Oct. 22, 1985

[54] BONUS BALL PINBALL GAME

[75] Inventor: Norman R. Clark, Burbank, Ill.

[73] Assignee: Bally Manufacturing Corporation, Chicago, Ill.

[21] Appl. No.: 492,416

[22] Filed: May 6, 1983

[51] Int. Cl.[4] ..... A63F 7/34

[52] U.S. Cl. ..... 273/121 A; 273/121 D

[58] Field of Search ..... 273/119 R, 119 A, 119 D, 273/121 R, 121 A, 121 B, 121 D, 121 E, 122 R, 122 A

[56] References Cited

U.S. PATENT DOCUMENTS

| | | | |
|---|---|---|---|
| 4,093,232 | 6/1978 | Nutting et al. | 273/121 A |
| 4,109,916 | 8/1978 | Breslow et al. | 273/121 A |
| 4,162,793 | 7/1979 | Cummings | 273/121 A |

*Primary Examiner*—Richard C. Pinkham
*Assistant Examiner*—Vincent A. Mosconi
*Attorney, Agent, or Firm*—Todd S. Parkhurst

[57] ABSTRACT

A pinball type game includes a play surface having at least one target thereon adapted to be engaged by either of two game balls which can be propelled onto the play surface so as to traverses the play surface and return to a return end thereof. The two game balls are distinguished from each other by color or other indicia and each has a corresponding return and ejector mechanism controlled by a control circuit which enables only one ball to be on the play surface at any given time. The control circuit is operatively connected to the targets so as to receive a signal when a target is engaged by a game ball, and is operative to increase the normal game score so as to provide a bonus score when the targets are engaged by a selected one of the balls when on the play surface, thus providing an increase in scoring opportunity should the selected one of the balls being placed in play during a player's turn. The control circuit includes a processor system operative to position the selected bonus ball for play and condition the targets for a bonus scoring routine.

16 Claims, 7 Drawing Figures

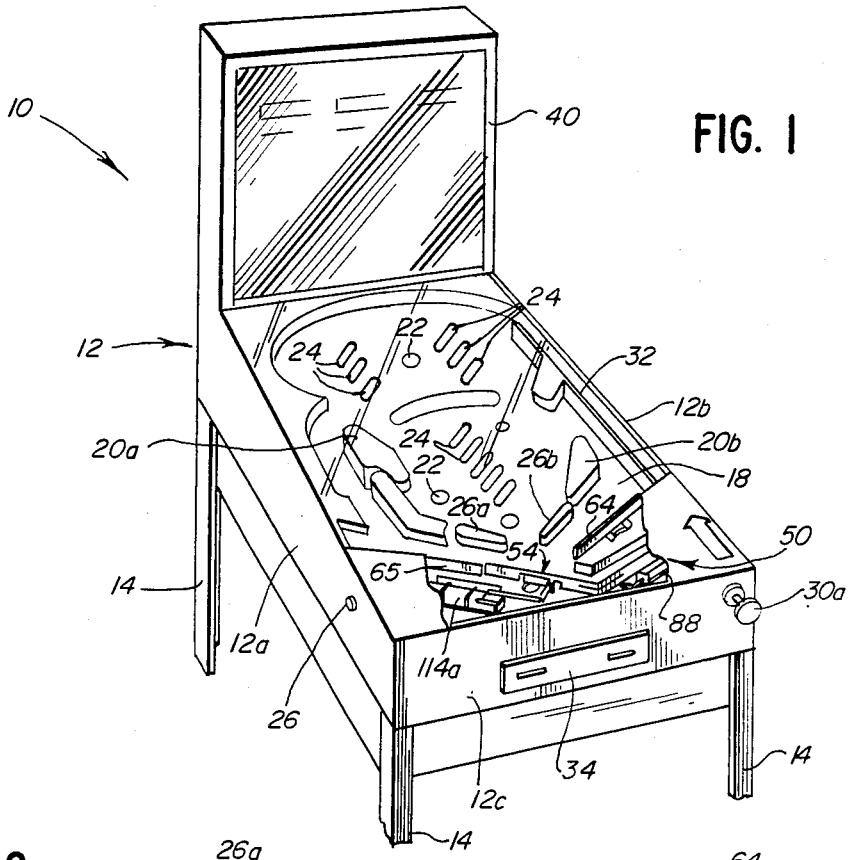
FIG. 1
FIG. 2
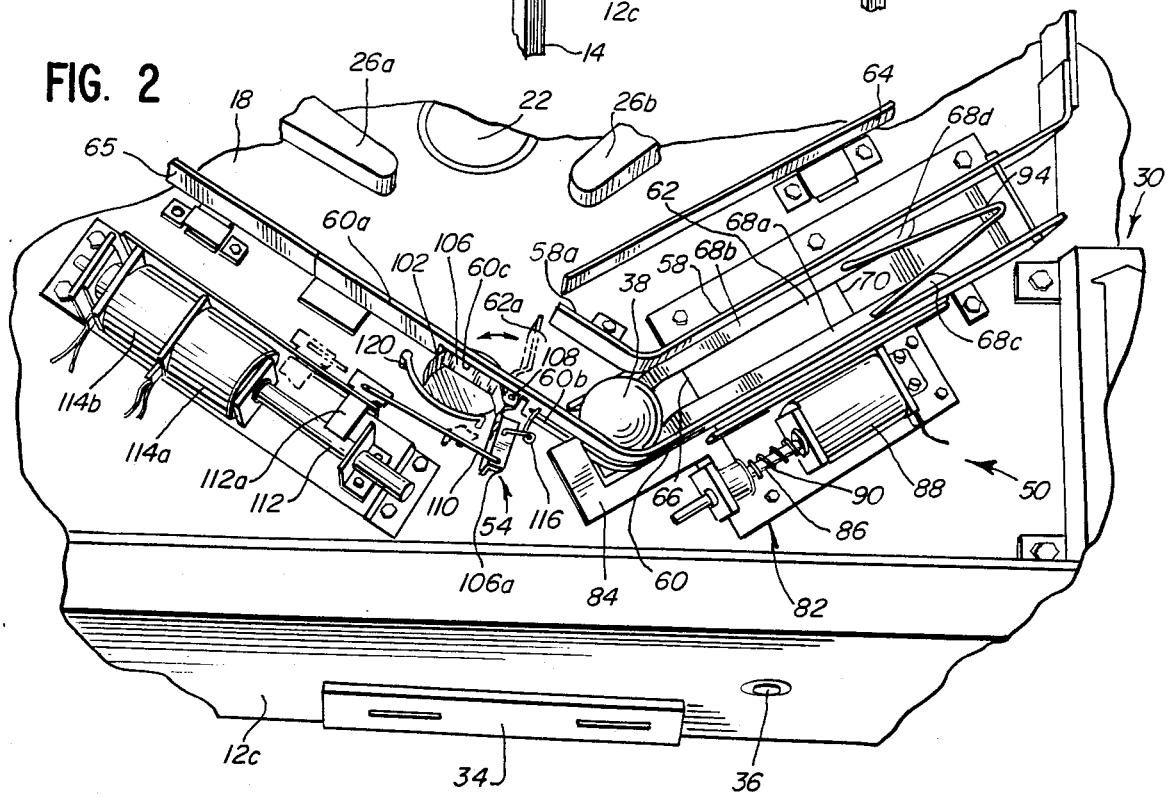

FIG. 3
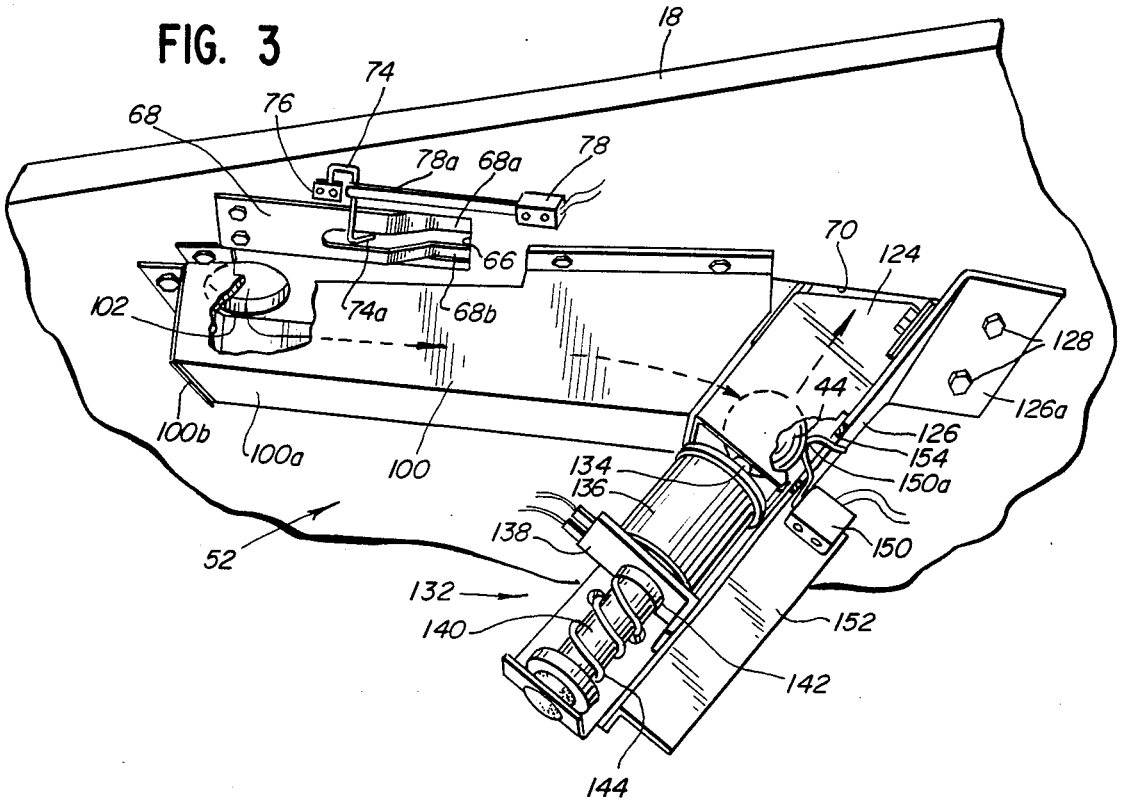
FIG. 4
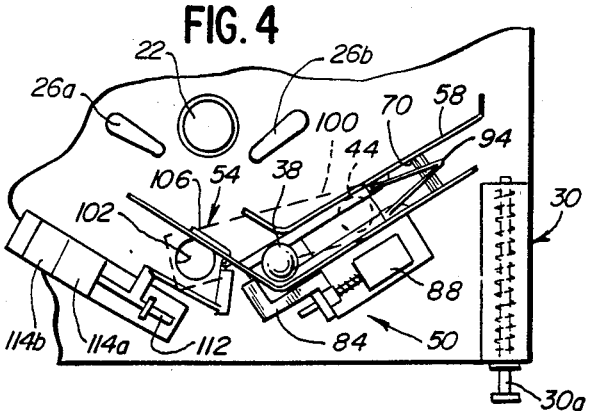
FIG. 5
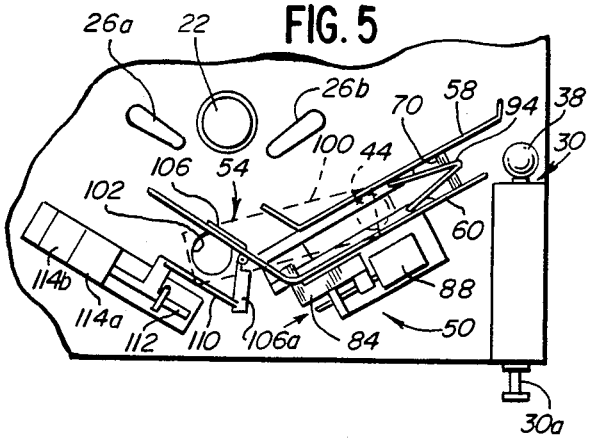
FIG. 6
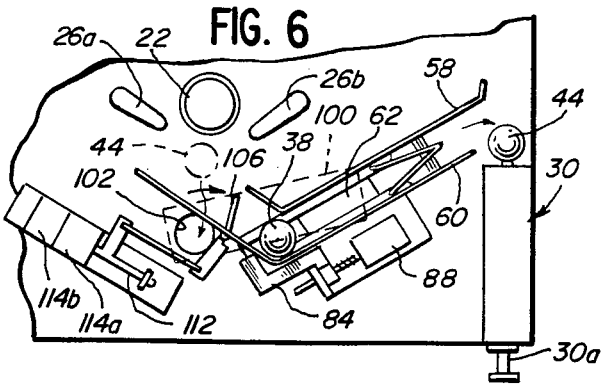
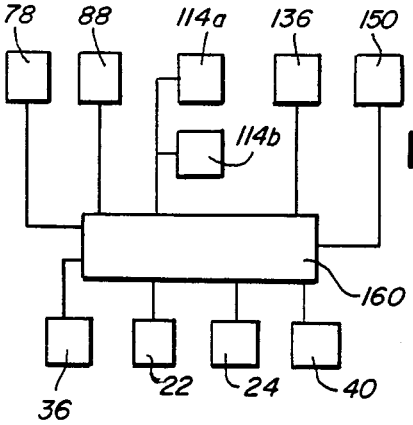
FIG. 7

BONUS BALL PINBALL GAME

BACKGROUND OF THE INVENTION

The present invention relates generally to amusement games, and more particularly to a novel pinball type game device including a play surface having various scoring targets and the like thereon, and which employs two distinct game elements, such as game balls, conditioned by a control circuit so that only one ball may be propelled onto the play surface at a given time and in a sequence unknown to the player, and wherein the scoring value for one or more of the targets is increased to provide bonus scoring for a selected one of the game balls.

Pinball type game devices of the type wherein game elements, such as game balls, may be propelled onto a play surface by a player so as to traverse a path determined by gravity and by player operated control means such that a game ball engages one or more scoring targets on the play surface, are generally known. Conventionally, the play surfaces of pinball type games are inclined downwardly toward the player, and a ball shooter mechanism enables the player to initiate movement of a game ball onto the play surface. The game ball gravitates toward the lower end of the play surface through lane forming elements such as bumpers of various forms, guide rails and operator controlled flippers which enable the operator to propel the ball toward various targets on and scoring openings in the play surface. The various targets and scoring openings have sensors which are conventionally connected in electronic circuits operative to activate scoring mechanisms and provide a scoring display with or without associated audible and visual effects. By selective actuation of the flippers, the operator can maintain the ball in play so as to maximize the number of targets and scoring openings engaged by the game ball and thus increase the game score attained.

While pinball games of the aforementioned type have been available for many years, they have for the most part employed hard wired electro-mechanical controls wherein the various target and scoring opening input switches are connected directly to the scoring mechanism and associated display lights and the like. More recent pinball type games have employed programmed logic arrays in the form of sequential logic microprocessors which are operative to sense the various target switch conditions in response to ball activation thereof and activate the scoring displays, etc. See, for example, U.S. Pat. No. 4,093,232 to D. J. Nutting, et al.

One characteristic common to most prior pinball type games is that each player has a substantially equal opportunity to obtain a game score as high as each other player for each ball propelled onto the play surface, the score for each ball played being a function of the number and/or combination of scoring elements engaged by the ball during play. Any bonus that might result from play of the particular game is generally in the form of an additional game play in response to attaining a predetermined minimum score during the previous game play. Thus, while prior pinball games have found generally wide acceptance as amusement games, when they are played on a competitive basis as by a player playing against his prior game score or by two or more competing players playing either in alternate player fashion or by each player completing a full game before the next player begins, if a player falls behind other players in score level attained, it is difficult for the trailing player to overcome his opponent.

SUMMARY OF THE INVENTION

One of the primary objects of the present invention is to provide a novel pinball type game device employing two distinct game balls and wherein play of a selected one of the game balls operates to provide increased score values for the various targets on the playfield over the score values during play with the other game ball, thus providing a bonus scoring opportunity should the selected one of the game balls be placed in play during a player's turn.

A more particular object of the present invention is to provide a pinball type game device which includes a play surface, target and flipper means on the play surface, a pair of distinct game balls, means for conditioning the game balls for propelling them in predetermined sequence onto the play surface such that the balls may be manipulated to engage the target means, and processor means operative to position the game balls for selective shooting, establish first level scoring values for the target means when a selected one of the game balls is in play, and establish second level scoring values for the target means different from the first level when the other game ball is in play on the play surface.

In accordance with one feature of the pinball game device in accordance with the invention, two distinct ball return and ejector mechanisms are provided for use with two distinct game balls. A ball control gate is operatively associated with the ball return and ejector mechanisms to enable guiding of the game balls to their corresponding return and ejector mechanism. Processor means detects the presence of each game ball within its corresponding return and ejector mechanism and conditions the ejector mechanisms for feeding the game balls to a shooter position in predetermined sequence unknown to the player. The processor means also effects a change in the score values of the various targets on the play surface when a selected one of the game balls is in play so as to provide bonus scoring for that ball.

Further objects, features and advantages of the invention, together with the organization and the manner of operation thereof, will become apparent from the following detailed description of the invention when taken in conjunction with the accompanying drawings wherein like reference numerals designate like elements throughout the several views.

BRIEF DESCRIPTION OF THE DRAWINGS

FIG. 1 is a fragmentary perspective view of a pinball type game embodying the present invention;

FIG. 2 is an enlarged fragmentary perspective view of the forward end of the pinball game of FIG. 1 but with the cover plate removed and with the ball control gate shown in an open position in phantom;

FIG. 3 is a fragmentary perspective view of the pinball game as viewed from beneath the forward end, portions being broken away for purposes of clarity;

FIGS. 4–6 schematically illustrate the ball return and ejector mechanisms in various operating positions under different modes of play; and FIG. 7 is a block diagram of an operating control circuit as employed with the pinball game of FIG. 1.

DESCRIPTION OF PREFERRED EMBODIMENT

Referring now to the drawings, and in particular to FIG. 1, the present invention is illustrated, by way of example, as being embodied in a pinball type amusement game device indicated generally at 10. The pinball game 10 includes a generally rectangular cabinet 12 supported on legs 14 and having upstanding side walls or panels 12*a,b* and a front end wall 12*c* in front of which a player stands during play. A substantially planar play surface 18 is supported within the cabinet 12 such that the play surface is inclined downwardly toward the front end wall 12*c*. In this manner, game elements, such as spherical game balls, introduced onto the play surface at its upper end normally gravitate toward the front end wall 12*c* which may be termed the return end of the pinball game. A transparent cover plate, conventionally made of a suitable glass or plastic, is preferably supported at the upper peripheral edges of the cabinet walls 12*a,b* and *c* to overlay the play surface in a known manner.

The play surface 18 has target means thereon in the form of one or more resilient bumpers, such as indicated at 20*a* and 20*b*, and scoring openings or ball sensors, indicated at 22 and 24, all of which may hereinafter be termed targets and which are selectively positioned on the play surface to define a playfield. The various targets are adapted to be engaged by a ball traversing the play surface and each may be adapted to provide a scoring signal on being engaged by a game ball, as is known.

Player controlled flippers, such as indicated at 26*a* and 26*b*, are pivotally mounted on the play surface 18 for control by flipper control switches, one of which is indicated at 26, conventionally mounted in the side walls or panels 12*a* and 12*b* for easy access by the player. Pop-type bumpers and/or other types of targets as conventionally employed with pinball type games may also be mounted on the play surface 18 if desired. A plunger type shooter mechanism of known design, indicated generally at 30 in FIG. 2, is supported on the front wall 12*c* adjacent the upper right-hand corner and has a plunger or handle 30*a* extending through the front wall for access by an operator. An upstanding rail 32 is preferably mounted on the play surface to establish a guide track or runway through which the game ball initially travels for release at the upper end of the playfield. A coin slot mechanism 34 may be mounted within the front wall 12*c* in the case of coin operated pinball game. The coin slot mechanism is of conventional design and enables insertion of a plurality of coins or tokens so as to provide game "credits" which enable successive games to be played without need for inserting a coin or token for each successive game. The slot mechanism conventionally enables insertion of coins by two or more players to enable multi-player play. A reset switch button 36 is also mounted on the front wall 12*c* and is operative to enable a player to reset the various scoring elements to zero at the outset of play or during some intermediate point in a game if a player elects to initiate play of the next successive game to which the player is entitled.

The pinball game 10 thus far described is of generally known construction and enables a player to propel a game element, such as a spherical game ball as indicated at 38 in FIG. 2, onto the play surface 18 such that the game ball enters onto the playfield at the upper end thereof and gravitates toward the lower end thereof during which the ball may pass over one or more scoring openings 22 or ball sensors 24 and impact one or more of the bumpers 20*a,b* or flippers 26*a,b* which enable the operator to again propel the ball toward the upper end of the playfield for continued play whereby to maximize the number of times the ball passes over a scoring opening or engages a scoring target. Conventionally, the various scoring targets in the playfield are adapted to produce an electrical signal upon being engaged or traversed by a game ball, and a control circuit is operative to sense the various score signals and provide a digital score display on a glass covered upstanding back cabinet 40 fixed on the main cabinet 12. The control circuit may also provide other visual effects on the play surface, as well as audible effects.

In accordance with the present invention, the pinball game 10 employs two distinct game balls which are preferably of substantially identical size and shape, but which are distinguishable from each other as by different color or the like. The aforementioned game ball 38 comprises one game ball, and a second game ball, indicated at 44 in FIG. 3, comprises the other of the two distinct game balls. In addition to the two distinct game balls 38 and 44, the present invention provides a ball return and ejector mechanism for each of the game balls, as indicated generally at 50 and 52, respectively, in FIGS. 2 and 3. In the illustrated embodiment, the ball return and ejector mechanism 50, which may be termed ball feeder means, is adapted to receive the game ball 38, which may be termed the regular game ball, at the return end of the play surface, and is operative to maintain ball 38 in a "home" or "ready" position and selectively move it from its home position to a shooter position relative to the shooter mechanism 30 for propelling it onto the play surface 18.

The ball return and ejector mechanism 52, which also may be termed ball feeder means, is adapted to receive the game ball 44, which for purposes of illustration may be termed the bonus ball, at the return end of the play surface and is operative to maintain bonus ball 44 in a "home" or "ready" position and selectively move it from its home position to a shooter position relative to the shooter mechanism 30 so as to enable the bonus ball to be propelled onto the play surface. As will be described more fully hereinbelow, the ball return and the ejecter mechanisms 50 and 52 are connected in a control circuit which includes a processor system operative to actuate the ball return and ejector mechanisms in a predetermined order so that only a selected one of the game balls 38 and 44 will be enabled for shooting onto the play surface at a given time.

As will become more apparent hereinbelow, in the preferred embodiment the processor is operative to prevent launching or shooting of the bonus ball 44 until after the regular ball 38 has first been played. Further, the processor is operative to prevent movement of either the regular ball 38 or bonus ball 44 to the shooter position unless the bonus ball is detected in its home position.

Gate means, indicated generally at 54, is operatively associated with the ball return and eject mechanisms 50 and 52 and the control circuit in a manner to enable selective guiding of the game balls 38 and 44 to their associated ball return and ejector mechanism after each game ball returns to the return end of the play surface following a play cycle. In this manner, the processor means can control feeding of a selected one of the game balls to a shooter position while simultaneously preventing movement of the other game ball to a shooter position. Additionally, the processor means is operative to condition the various targets on the play surface for establishing different scoring levels or values dependent upon the particular game ball which has been propelled onto the play surface. By conditioning the processor means to feed the game balls 38 and 44 to the shooter mechanism 30 in a sequence unknown to the player, the game will be conditioned to provide bonus scoring points should the bonus ball 44 be moved to the shooter position.

Referring to FIG. 2, the ball return and ejector mechanism 50 concludes a pair of substantially parallel guide plates 58 and 60 which are suitably secured to the play surface 18 in upstanding relation so as to define a guide chute or runway 62 therebetween. The guide chute 62 has a lateral width slightly greater than the diameter of the ball 38 and defines an entrance end 62*a* adapted to receive ball 38 therein when the gate means 54 is in a closed position as illustrated in solid lines in FIG. 2. The guide plate 60 is generally V-shaped in plan configuration so as to define an angularly upwardly directed portion 60*a* which cooperates with a simiarly angled end 58*a* on guide plate 58 to define the ball entry opening 62*a* therebetween. Upstanding guide plates 64 and 65 are suitably mounted in upstanding relation on play surface 18 to assist in guiding game balls to their respective ball return and ejector mechanisms 50 at the return end of the play surface.

A rectangular opening 66 in the play surface 18 receives a pair of parallel spaced rails 68*a* and 68*b* of a runway plate 68 which is secured to the lower side of the play surface 18 as illustrated in FIG. 3. The rails 68*a* and 68*b* are inclined upwardly as they pass through the opening 66 so as to define a receiving pocket for the game ball 38 after it enters the entry end 62*a* of the guide chute 62. The rails 68*a* and 68*b* lie against the upper surface of play surface 18 and terminate at forward ends 68*c* and 68*d*, respectively, which overlie a second rectangular opening 70 in the play surface, the purpose of which will become more apparent hereinbelow.

To detect the presence of the game ball 38 within the pocket established by the runway plate 68, a ball sensor arm 74 (FIG. 3) is pivotally mounted on the lower side of play surface 18 through a bracket 76 such that a sensor arm end 74*a* extends upwardly between the rails 68*a,b* sufficiently to be depressed by the game ball 38 when in the receiving pocket. A suitable switch 78 is mounted on the lower side of play surface 18 and has a switch arm 78*a* which underlies the ball sensor arm 74 such that the switch arm is actuated by the ball sensor arm when game ball 38 is within the overlying receiving pocket. Switch 78 is connected in the processor control circuit and is adapted to provide a signal indicating the presence or absence of game ball 38 in a ready position within the receiving pocket.

Referring again to FIG. 2, the ball return and ejector mechanism 50 includes an ejector assembly, indicated generally at 82, which is operative to eject game ball 38 from its receiving pocket within opening 66 and move it to a shooting position at the forward end of the shooter mechanism 30, as shown in FIG. 5. The ejector assembly 82 includes a generally Z-shaped ejector arm 84 which is mounted on a movable plunger or core piece 86 of a solenoid coil 88. A coil spring 90 is coaxial on the plunger 86 so as to bias the ejector arm to an extended position as shown in FIG. 2. A slot or opening 60*b* is formed in guide plate 60 to enable the ejector arm 84 to engage game ball 38 when in its receiving pocket and move the ball along rails 68*a,b* to a shooting position upon energizing the solenoid coil 88 through a control signal.

A V-shaped gate member 94, which may be made from suitable spring wire or the like, has its free ends pivotally mounted within suitable openings in the guide rails 68*a,b* and overlies the opening 70 so as to enable passage of the game ball 38 over opening 70 into a shooting position. The gate member 94 is adapted for upward pivotal movement to enable passage of the game ball 44 upwardly through the opening 70 as will be described.

With reference to FIG. 3, the ball return and ejector mechanism 52 includes a generally U-shaped ball return chute 100 which has its upper lateral edges secured to the lower side of play surface 18 and has a downwardly inclined lower wall 100*a* so as to define a downwardly inclined ball return chute. The left-hand end of the ball return chute 100 is closed by an end wall 100*b* and underlies a circular ball return opening 102 formed in the play surface 18 of sufficient size to enable the bonus game ball 44 to pass downwardly into ball return chute 100 upon returning to the return end of the playfield.

As illustrated in FIG. 2, the ball return opening 102 is positioned in play surface 18 to generally underlie end 60*a* of the guide plate 60 which has a rectangular opening or recess 60*c* formed therein immediately overlying the ball return opening 102. The gate means 54 includes a gate member 106 which is pivotally mounted on guide plate 60 for pivotal movement about a pivot axis 108. The gate member 106 has an arm portion 106*a* connected through a connecting rod 110 to an arm 112*a* of an actuator 112 which is fixed on a plunger rod or core piece (not shown) extending through a pair of tandem solenoid coils 114*a* and 114*b*. Gate member 106 has a configuration such that when the actuator 112 is extended, the gate member closes off the rectangular recess 60*c* and prevents entry of a game ball into the return opening 102.

The solenoid coils 114*a* and 114*b* are connected in the aforementioned processor control circuit such that when the bonus ball 44 is on the playfield, a selected one of the coils 114*a,b* is energized to open gate member 106 and enable passage of the bonus ball through opening 102 after which the other of the solenoid coils 114*a,b* is energized to close the gate member 106. Preferably, a suitable spring 116 is interconnected between the arm 106*a* of gate member 106 and the guide plate 60 so as to bias the gate member to its closed position. A ball return guide wire 120 is mounted on the play surface 18 adjacent the ball return opening 102 to insure passage of the bonus ball 44 into opening 102. In its open position, gate 106 prevents bonus ball 44 from entering the entry end 62*a* of the ball return and ejector mechanism 50 for the game ball 38.

Referring again to FIG. 3, the end of the ball return chute 100 opposite the closed end wall 100*b* is open and communicates with an upwardly inclined guide chute formed internally of a generally U-shaped open ended channel 124 which is mounted on an upwardly inclined plate 126 having an upper end 126*a* fixed to the lower side of the play surface 18 as through screws 128. The upper open end of guide chute 124 is received within the opening 70 in the play surface 18.

A ball ejector assembly, indicated generally at 132, is mounted on the support plate 126 adjacent the lower open end of the guide chute 124. The ejector assembly 132, which may alternatively be termed a kicker assembly, has a ball engaging plunger or kicker 134 which is supported for longitudinal movement centrally within a solenoid coil 136 fixed on a suitable bracket 138. The ball engaging plunger or kicker 134 extends axially into the solenoid coil 136 and is connected to a cylindrical actuator rod or plunger 140 which is longitudinally slidable within a bushing 142 supported within an opening in the bracket 138. A coil compression spring 144 is coaxial on the actuating rod 140 in a manner to bias plunger 134 toward the solenoid coil 136. Solenoid coil 136 is connected in the control circuit such that application of a control signal to the solenoid 136 serves to momentarily move the plunger 134 longitudinally outwardly to impact the bonus game ball 44 when in its ready position within the chute 124. On impact by plunger 134, bonus ball 44 moves upwardly through opening 70 in the play surface 18 and to the shooting position, as illustrated in FIG. 6. Gate member 94 is pivoted upwardly by bonus ball 44 as it passes upwardly through opening 70 after which the gate member returns to a position bridging the opening 70 to enable subsequent movement of the regular game ball 38 to a shooting position.

To detect the presence of bonus ball 44 in its ready position at the lower end of the guide chute 124, a sensor switch 150 is mounted on a mounting bracket 152 which is fixed to the plate 126 such that the switch 150 is adjacent an opening 154 in plate 126, as illustrated in FIG. 3. The sensor switch 150 has a sensor arm 150*a* which projects upwardly through opening 154 and is actuated by the bonus ball 44 when in its ready position. Switch 150 is connected in the control circuit and provides a signal indicating the presence or absence of bonus ball 44 in a position ready for movement to a shooting position.

FIG. 7 schematically illustrates in block diagram form a control circuit for the pinball game 10. The sensing switch 78 for the regular game ball 38 and the corresponding solenoid coil 88 of the ejector assembly 82 are connected in circuit with a suitable processor system indicated schematically at 160. The processor system 160 may comprise a 6800 processor, such as available from Motorola Company, with memory and support circuitry, or may be embodied on a single chip microcomputer. An example of suitable processor circuitry is disclosed in U.S. Pat. No. 4,093,232 to D. J. Nutting et al which is incorporated herein by reference. The control solenoid coils 114*a* and 114*b* of gate means 54 are also connected to the processor system 160 as are the ball sensing switch 150 and actuating solenoid 136 of the ejector mechanism 132 for the bonus game ball 44.

A typical game format programmed into the processor system 160 may operate as follows: With the game balls 38 and 44 in their home or return positions depressing the associated sensing switch arms 74 and 150*a*, respectively, the processor system 160 is conditioned to close gate 106 so as to prevent a game ball from entering the return opening 102 in the playfield, as shown schematically in FIG. 4. Assuming that a player has energized the circuitry for the game device 10, as by insertion of a proper coin or token in the case of a coin operated pinball game, or by turning on a main power switch in the case of a noncoin operated pinball game, the processor system 160 and associated control circuitry is responsive to the player depressing the reset switch 36 so as to energize the solenoid coil 88 and move the regular game ball 38 into the shooting position at the forward end of the shooter mechanism 30, as shown in FIG. 5. The player may then propel game ball 38 onto the play surface by actuating the shooter plunger 30*a* after which ball 38 traverses the playfield and may engage one or more of the bumpers 20*a,b* and activate one or more of the targets 22 and 24 until the game ball eventually reaches the return end of the playfield where upon it enters the entry end 62*a* of the ball guide or runway 62 and returns to its ready position. In this position, ball 38 again actuates ball sensor switch 78 indicating to the processor system that the regular game ball 38 is again in proper position for subsequent play. This same cycle may be repeated a number of times by the player depending upon the number of "plays" he is entitled to for a given coin operation or in accordance with a predetermined number of plays in a multi-player competition.

During play with the regular game ball 38, each engagement of the regular game ball with one of the bumpers 20*a,b* and/or target members 22, 24 results in a score signal being sent to the processor system 160 which operates to establish a cummulative score level dependent up a first scoring routine programmed into the processor system. The processor system 160 is preferably operable to display a cumulative digital score on the upstanding back cabinet 40 enabling the player or players to observe their cumulative game score.

In accordance with an important feature of the present invention, the processor system 160 and associated control circuitry are operative to energize the solenoid coil 136 of the bonus ball ejector mechanism 132 in selective sequence with the regular game ball 38, which sequence is unknown to the players. Thus, at some time during play of the pinball game device 10, the processor system 160 will cause the bonus ball 44 to be ejected into the shooting position, as shown in FIG. 6, after return of the regular ball 38 to its home position. The operator may then propel bonus ball 44 onto the playfield. As aforementioned, the bonus ball 44 is preferably visually distinct from the regular game ball 38 so that the player recognizes he is in a bonus scoring situation. The processor system 160 is operative to automatically change to a different scoring routine when bonus ball 44 is in play so as to change the score level for each of the targets on the playfield. Preferably, the player receives a bonus score level from each of the targets engaged by the bonus ball 44.

Concurrently with ejecting the bonus ball 44, the processor system 160 energizes the appropriate solenoid 114*a* or 114*b* to open gate 106 so that when the bonus ball returns to the return end of the playfield, it will enter the ball return opening 102 and again pass to its ready position engaging the shooter or kicker plunger 134 and depress the sensing switch arm 150*a* to again indicate to the processor control circuit that the bonus ball has returned to its home or ready position. With gate 106 in its open position, entry of the bonus ball into the return end 62 of the return and ejector mechanism 50 is prevented. Following return of the bonus ball to its ready position, the processor system 160 may again close gate 106 and condition the various components to eject or move the regular game ball 38 into shooting position or again move the bonus ball 44 into shooting position.

The control circuit processor is preferably conditioned so that the regular game ball 38 will be launched into the shooting position as the first ball to be played at the start of each game upon depressing the reset button 36. Further, the processor is conditioned so that neither of the actuating solenoids 88 or 136 will be energized unless the bonus ball 44 is in its home position as sensed by switch arm 150*a*. The processor conditions the game to kick out or launch either the regular game ball 38 or bonus ball 44 as the next ball to be played, even though the regular game ball 38 is on the play surface, but will not actually energize either of the solenoids 88 or 136 until the regular game ball 38 returns to its home position. In this manner, if the reset button 36 is depressed while one of the game balls 38 or 44 is on the play surface, the regular game ball 38 will always be the next ball moved to the shooting position after the ball in play returns so that both balls are in their home positions. This prevents the regular and bonus balls from both being on the play surface at the same time.

The processor may be programmed to launch the bonus ball 44 into shooting position in a predetermined numbered sequence with the regular game ball, except when the bonus ball would otherwise be the first ball launched after depressing the reset button 36 to initiate a new game. Alternatively, the processor could be programmed to launch the bonus ball 44 into shooting position in a purely random sequence with the regular game ball, such as in response to a game ball on the play surface engaging a particular series of targets unknown to the player or attaining a predetermined minimum score level with the particular ball on the play surface, again unknown to the player. In either case, the processor is operative to launch or move the game balls into shooting position in selective sequence unknown to the player.

While the illustrated embodiment of the pinball game 10 has been described as employing an electronic processor system in the control circuit to effect predetermined energizing of the various actuating solenoids and changing of the scoring level or routine for the targets on the playfield, a mechanical system could also be employed which utilizes driven timing cams and the like to effect selective movement of the game balls to their shooting positions, and activate switches establishing changes in scoring value levels for the various targets dependent upon the particular one of the distinct game balls in play.

Thus, in accordance with the present invention, a pinball type device is provided which includes two distinct game balls, each of which has a ball return and ejector mechanism associated therewith, and employs a gate operative to direct the game balls to their respective ball return and ejector mechanisms. The pinball game includes processor means operative to detect the presence of each distinct game ball within its corresponding return and ejector mechanism and condition the associated ejector mechanisms for feeding the game balls to a shooter position in a sequence unknown to the player. The processor means also effects a change in the score level values or routine for the various target means on the playfield such that when a selected one of the game balls, such as a bonus ball, is in play on the playfield, the score level for the various targets is increased to provide a bonus scoring mode.

While a preferred embodiment of the present invention has been illustrated and described, it will be understood to those skilled in the art that changes and modifications may be made therein without departing from the invention in its broader aspects. Various features of the invention are defined in the following claims:

What is claimed is:

1. In a pinball type game, the combination comprising;

a play surface, a pair of distinct game balls, a first ball return and ejector means defining a first path of ball travel and distinct from said play surface and adapted to receive a selected one of said game balls and move it along the first path to a shooting position in response to a first predetermined signal, second ball return and ejector means defining a second path of ball travel distinct from the first path and distinct from said play surface and adapted to receive the other of said balls and move it along the second path of ball travel to a shooting position in response to a predetermined second signal, gate means for directing a returning ball to said first ball return means and first path and alternatively directing the returning ball to said second ball return means and second path, and control circuit means cooperative with said first and second ball return and ejector means and said gate means and being operative to apply said first and second predetermined signals thereto in a manner to move said game balls to their corresponding shooting positions in selective sequence along the selected defined and distinct paths.

2. A pinball type game as defined in claim 1 wherein said distinct game balls are of substantially equal size, but of different color.

3. A pinball type game as defined in claim 1 including a shooter mechanism defining said shooting position, said shooter mechanism enabling the player to propel each of said game balls onto the play surface when moved to said shooting position.

4. A pinball type game as defined in claim 1 wherein said gate means is operatively associated with said first and second ball return and ejector means in a manner to enable selective guiding of said game balls to said ball return and ejector means.

5. A pinball type game as defined in claim 4 wherein each of said ball return and ejector means includes a guide chute adapted to receive either of said game balls therein, said gate means including a gate member operatively associated with a selected one of said guide chutes in a manner to enable passage of a selected one of said game balls to said selected guide chute while simultaneously preventing passage of said selected game ball to the other of said guide chutes.

6. A pinball type game as defined in claim 5 wherein said gate means includes actuator means cooperative with said gate member and connected in said control circuit means in a manner to enable passage of said selected game ball to said selected guide chute only after said selected game ball has been moved to said shooting position.

7. A pinball type game as defined in claim 1 including target means on said play surface adapted to be engaged by a ball traversing said play surface, said target means being connected in said control circuit and adapted to apply a scoring signal to said control circuit when engaged by a game ball, said control circuit being operative to establish a first scoring value level for said target means when engaged by a selected one of said distinct game balls and establish a second scoring value level for said target means different from said first scoring value level when said target means is engaged by the other of said distinct game balls.

8. A pinball type game as defined in claim 7 wherein said control circuit includes a processor system having at least two different scoring routines each of which is adapted to establish one of said first and second scoring value levels.

9. A pinball type game as defined in claim 1 wherein each of said first and second ball return and ejector means defines a ready position for the corresponding game ball when received therein, and including ball sensor means operatively associated with each of said ball return and ejector means and adapted to provide a signal to said control circuit indicating the presence of the corresponding game ball in its said ready position.

10. In a pinball type game, the combination comprising:

a play surface, a pair of distinct game balls, at least one target on said play surface adapted to establish a scoring signal when engaged by either of said game balls traversing said play surface, first ball feeder means operatively associated with said play surface and adapted to receive a selected one of said game balls and move it to a shooting position in response to a first predetermined signal so as to enable said selected game ball to be propelled onto the play surface, second ball feeder means separated from the plane of the play surface but operatively associated with said play surface and adapted to receive the other of said game balls and move it to a shooting position in response to a predetermined second signal so as to enable said other game ball to be propelled onto the play surface, control circuit means cooperative with said first and second ball feeder means and operative to apply said first and second predetermined signals thereto in a manner to move said game balls to their corresponding shooting positions in selective sequence, said control circuit being cooperative with said target so as to receive scoring signals therefrom and being adapted to establish a score level indication in response to receipt of said scoring signals which is different for each of said distinct game balls, a shooter mechanism defining said shooting position, each of said first and second ball feeder means being adapted to move its corresponding game ball to said shooting position through a substantially different path, each of said ball feeder means defining a separate ready position for its corresponding game ball and an at least one ejector assembly operative to move the corresponding game ball from its ready position to said shooting position in response to the corresponding predetermined signal from said control circuit means.

11. A pin ball type game as defined in claim 10 including gate means operatively associated with at least one of said first and second ball feeder means and adapted to enable return of the corresponding game ball thereto when disposed on the play surface while preventing return of the other game ball thereto when disposed on the play surface.

12. A pinball type game as defined in claim 10 wherein said control circuit includes processor means enabling application of said first and second predetermined signals only when the corresponding game balls are in predetermined positions.

13. A pinball type game as defined in claim 12 wherein each of said ball feeder means includes ball sensor switch means operative to detect the presence of the corresponding game ball in its said ready position, said ball sensor switch means being connected in said control circuit and each being adapted to provide a signal thereto indicating the presence or absence of the corresponding game ball in its said ready position.

14. In a pinball type game device, the combination comprising;

a play surface, a pair of distinct game balls, target means on said play surface adapted to be engaged by a game ball traversing said play surface, said target means being operative to establish a scoring signal upon being engaged by a game ball, first ball return and ejector means operatively associated with said play surface, defining a first ball ready position and adapted to receive a selected one of said game balls and move it from the first ball ready position to a shooting position in response to a first predetermined signal, second ball return and ejector means operatively associated with said play surface, defining a second ball ready position distinct from the first ball ready position, and adapted to receive the other of said balls and move it to a shooting position from the second ball ready position in response to a second predetermined signal, gate means operatively associated with at least one of said first and second ball return and ejector means so as to enable the corresponding game ball to be received thereby while simultaneously preventing the corresponding game ball from being received by the other of said first and second ball return and ejector means, and control circuit means cooperative with said first and second ball return and ejector means and operative to apply said first and second predetermined signals thereto in a manner to move said game balls to their corresponding shooting positions in selective sequence.

15. A pinball type game as defined in claim 14 wherein said control circuit means includes processor means adapted to receive said scoring signals from said target means and establish scoring value levels for said target means which are different for each of said two distinct game balls.

16. A pinball type game as defined in claim 15 wherein each of said ball return and ejector means includes ball sensor means operative to provide a control signals in response to the presence of a game ball in the corresponding ready position, said control circuit being adapted to receive said control signals and being inoperative to apply said predetermined signals to said ball return and ejector means unless a selected one of said game balls is present in its ready position.

* * * * *